US006112660A

United States Patent [19]

Junghans et al.

[11] Patent Number: 6,112,660

[45] Date of Patent: Sep. 5, 2000

[54] METHOD AND DEVICE FOR THE CONTROLLED TRANSFER OF PRINTING INK

[75] Inventors: Rudi Junghans, Wilhelmsfeld; Georg Rössler, Angelbachtal, both of Germany

[73] Assignee: Heidelberger Druckmaschinen Aktiengesellschaft, Heidelberg, Germany

[21] Appl. No.: 09/134,303

[22] Filed: Aug. 14, 1998

Related U.S. Application Data

[63] Continuation-in-part of application No. 08/960,094, Oct. 27, 1997, abandoned, which is a continuation of application No. 08/541,631, Oct. 10, 1995, abandoned.

[30] Foreign Application Priority Data

Oct. 10, 1994 [DE] Germany ..... 44 36 102

[51] Int. Cl.[7] ..... B41F 31/00

[52] U.S. Cl. ..... 101/350.3; 101/352.06

[58] Field of Search ..... 101/349.1, 350.1, 101/350.3, 351.1, 351.3, 351.4, 352.01, 352.04, 352.05, 352.06, 352.09

[56] References Cited

U.S. PATENT DOCUMENTS

| | | |
|---|---|---|
| 3,688,696 | 9/1972 | Treff . |
| 3,765,328 | 10/1973 | Treff et al. . |
| 4,524,692 | 6/1985 | Rodvelt . |
| 4,632,029 | 12/1986 | Simeth . |
| 5,566,613 | 10/1996 | Stoffler . |

FOREIGN PATENT DOCUMENTS

| | | |
|---|---|---|
| 1 531 691 | 7/1968 | France . |
| 1 761 394 | 8/1972 | Germany . |
| 2 144 636 | 3/1973 | Germany . |
| 2 341 510 | 4/1974 | Germany . |
| 33 24 448 C1 | 2/1985 | Germany . |
| 39 35 215 A1 | 5/1990 | Germany . |
| 1 215 517 | 12/1970 | United Kingdom . |
| 2 193 926 | 2/1988 | United Kingdom . |
| 2 225 750 | 6/1990 | United Kingdom . |

*Primary Examiner*—Kimberly Asher
*Attorney, Agent, or Firm*—Herbert L. Lerner; Laurence A. Greenberg; Werner H. Stemer

[57] ABSTRACT

Ink is accurately metered in the defined transfer thereof from a fountain roller to a first ink roller in a printing unit. A ductor roller is swiveled back and forth between the ink fountain and the ink roller with a swivel mechanism. The swivel mechanism is driven independently of a main drive of the printing unit and with a discontinuous drive. Several parameters are thereby individually adjusted, among them a phase relationship between the ductor roller and a plate cylinder of the printing unit, a number of ductor beats per revolution of the cylinders of the printing unit, and a contact time of the ductor roller at the fountain roller and a contact time of the ductor roller at the first ink roller.

11 Claims, 5 Drawing Sheets

METHOD AND DEVICE FOR THE CONTROLLED TRANSFER OF PRINTING INK

CROSS-REFERENCE TO RELATED APPLICATION

This is a continuation-in-part application of application Ser. No. 08/960,094, filed on Oct. 27, 1997, now abandoned which was a continuation of application Ser. No. 08/541,631, filed on Oct. 10, 1995, now abandoned.

BACKGROUND OF THE INVENTION

1. Field of the Invention

The invention relates to a device and a method for the accurately metered transfer of printing ink between a fountain and a first ink roller. More particularly, the invention pertains to offset printing wherein a ductor roller is swiveled back and forth between a fountain roller and a first ink roller by a swivel mechanism that is independent of the main drive of the printing press.

2. Description of the Related Art

It has become known heretofore from German patent publication DE 39 35 215 A1 to use a ductor roller cam driven by an electromotor. The reference teaching is particularly adapted to fast-running, sheet-fed rotary printing presses, and adjusts the ductor lifting speed independently of the printing unit speed. That invention allows at high press speeds to maintain the ductor frequency below the dynamic limit of the ductor ink unit so as to satisfy the quality requirements of the color print.

The phase relationship between the movement of the printing unit and the movement of the ink ductor not being coupled is considered disadvantageous, and the inability to make a defined adjustment of the phase position of the ductor relative to the printing unit drive is also considered disadvantageous.

A further disadvantage is that the contact time of the ink ductor cannot be adjusted either at the fountain roller or at the first ink applicator roller.

According to the disclosure in German patent publication DE 23 41 510, an electromotor drives an inking unit control mechanism. Synchronization is effected by selecting a gearwheel that is driven by a main drive shaft, and an inking unit control mechanism following that gearwheel. A relative phase position of the inking unit relative to the main drive is adjustable and controlled through a pulse transducer, which senses the gearwheel position.

A disadvantage of that device is that the contact time of the ductor roller at the fountain roller and at the first inking roller is predetermined by a cam control and individual adjustments are not possible.

German Patent DE 33 24 448 C1 describes an ink metering device for letterpress and offset printing machines. The ductor roller of that device includes several mutually adjacent disks that are individually switched. The configuration leads to a problem whereby a plurality of adjusting elements and sensors are necessary for regulating and monitoring the individual disks. The resulting processing of the actuating and monitoring signals requires substantial computing capacity and a large share of available computer time. The mechanical problems resulting from the division of the ductor roller into individual disks include: severe soiling through the gaps formed in the division; a substantial amount of effort in the adjustment for the even contact of each disk at the fountain roller and at the inking roller; and exact balancing of each individual disk to avoid oscillations.

SUMMARY OF THE INVENTION

It is accordingly an object of the invention to provide a device and a method for the controlled transfer of printing ink, which overcomes the above-mentioned disadvantages of the heretofore-known devices and methods of this general type and which provides a novel inking process and an associated ink ductor device that is driven independently of the drive of the printing machine (printing unit) and that is individually adjustable.

With the foregoing and other objects in view there is provided, in accordance with the invention, an assembly for the exactly metered transfer of printing ink in a printing unit, comprising:

a fountain roller receiving ink from an ink fountain, and a first ink roller of the printing unit spaced apart from the fountain roller;

a ductor roller and a swivel mechanism for swiveling the ductor roller back and forth between the fountain roller and the first ink roller; and the swivel mechanism including a swivel drive being operable independently of a main drive of the printing unit, and being a discontinuous drive. The discontinuous drive is preferably a linear drive, such as a linear motor or a piezo actuator.

As set forth above, the ink ductor roller alternately contacts the fountain roller and the first ink distribution roller. Accordingly, an ink ductor cycle is defined as the number of times the ink ductor roller contacts the first ink distribution roller per revolution of the plate cylinder. One such back-and-forth motion of the ductor roller is defined as one ductor beat With the above and other objects in view there is also provided, in accordance with the invention, a method of transferring printing ink from a fountain roller to a first ink roller in a printing unit, wherein a ductor roller is swiveled back and forth between an ink fountain and a first ink roller by a swivel mechanism, which is driven independently of a main drive of the printing machine, which includes the steps of:

individually adjusting each of the following parameters:

a phase relationship between the ductor roller and a plate cylinder of the printing unit;

a number of ductor beats per machine revolution (revolution of the cylinders of a printing unit); and a contact time of the ductor roller at the fountain roller and a contact time of the ductor roller at the first ink roller.

In accordance with another mode of the invention, the method further comprises adjusting the number of ductor beats per machine revolution, and the contact time of the ductor roller at the fountain roller and at the first ink roller differently during a printing operation as compared to a non-printing operation.

In accordance with another mode of the invention, one or more ductor beats are omitted after one or several ductor beats.

In accordance with a concomitant feature of the invention, the method comprises driving the swivel mechanism such that, upon print shut-down, the ductor roller is in contact with the ink distribution roller.

The advantage of the invention is found in the simplicity of the construction and in the multiplicity of variation possibilities given by the independence of the ink ductor.

The structural simplification is found in the fact that no complicated transmission, linkages, etc., are necessary for deriving the motion from the gear train. The synchronization relative to the main drive is effected through an incremental transducer that is present in any case and that is read into a computer system and evaluated therein.

The novel computer-regulated system realizes several advantages.

First, the phase position of the ductor, i.e., the point in time in which the ductor contacts the first inking roller, can be adjusted such that possibly incurred oscillations have the least impact on the print quality. The adjustment could be, for instance, the time when the ink applicator rollers face the groove in the plate cylinder. Another possibility could be to select a position on the printed image that is least critical.

Second, the direct and discontinuous drive of the ductor swivel assembly leads to the advantage that the contact speed at exactly the moment when the ductor roller contacts the fountain roller or the first ink roller may be chosen such that virtually no vibrations are induced.

The adjustable contact time at the fountain roller and at the first ink roller offers the printing press operator the advantage that he or she may freely choose the ductor rhythm, i.e., the number of ductor swivel movements per machine rotation (revolution of the cylinders of a printing unit), independently of the subject image to be printed. At small lifting speed, it is possible to transport correspondingly more ink from the fountain roller to the first ink roller, which makes it further possible to influence the amount of ink additionally with the thickness of the ink layers, and, thus, to adjust the same with zonal variations. Reduced lifting speeds are only chosen when a subject is to be printed with relatively little inking. As a rule, ½ or ⅓ speed adjustment is chosen. It is thereby also possible to adjust a different lifting speed or rhythm in each printing unit.

With a ductor motion that is operated independently of the machine phase (the phase of the plate cylinder of the printing unit), it is a further possibility for the ductor speed to be adjusted unevenly, i.e., one or more ductor movements may be omitted after a certain number of ductor movements.

A further advantage of the novel control is that, when the printing operation of the printing unit is stopped, the drive is stopped such that the ductor roller happens to contact the ink oscillator roller at stillstand.

Other features that are considered as characteristic for the invention are set forth in the appended claims.

Although the invention is illustrated and described herein as embodied in a device and method for the controlled transfer of printing ink, it is nevertheless not intended to be limited to the details shown, because various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
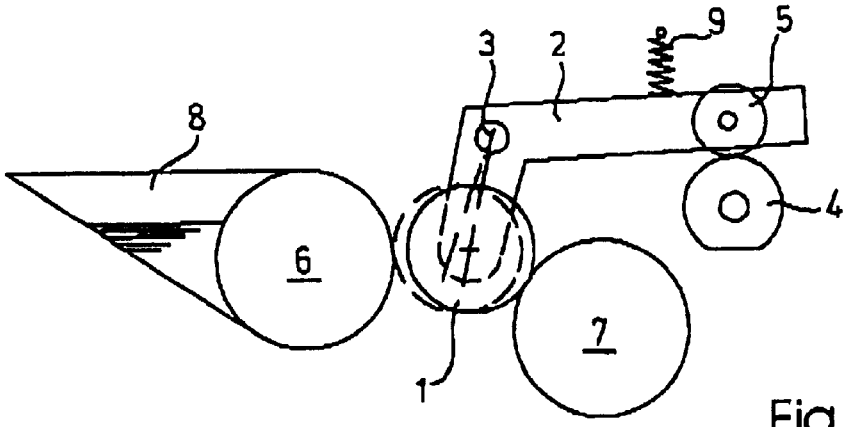
FIG. 1 is a schematic view of an assembly for swivelling a ductor roller between a fountain roller and an ink distribution roller according to the invention.

In all the figures of the drawing, sub-features and integral parts that correspond to one another bear the same reference symbol in each case.

Referring now to the figures of the drawing in detail and first, particularly, to FIG. 1 thereof, there is seen a ductor roller or vibrator 1, which is mounted in an angled lever 2. The angled lever 2 is articulated about a pivot point 3 and is moved up and down by a cam drive 4 through a cam roller 5. The articulation causes the ductor roller 1 to swivel back and forth between a fountain roller 6 and an ink distribution roller 7. One such back-and-forth motion of the ductor roller 1 is defined herein as one ductor beat.

In alternative terminology, the fountain roller 6 may be referred to as the ductor, the roller 1 may be referred to as the vibrator and the roller 7 may be referred to as the oscillator.

When the ductor roller 1 is in contact with the fountain roller 6, the ductor roller 1 receives ink that was taken by the fountain roller 6 from a fountain or ink supply box 8. After swivelling, the ductor roller 1 transfers the ink to the ink distribution roller 7. The fountain roller 6 and the ink distribution roller 7 are driven through a non-illustrated gear train or by a non-illustrated motor. The ink ductor roller 1 does not have a drive. Rather, the ductor roller 1 is rotatably driven by friction with the fountain roller 6 on the one hand and with the ink roller 7 on the other hand. A spring 9 ensures that the roller 5 always rolls on the cam drive 4.

Figure 2:
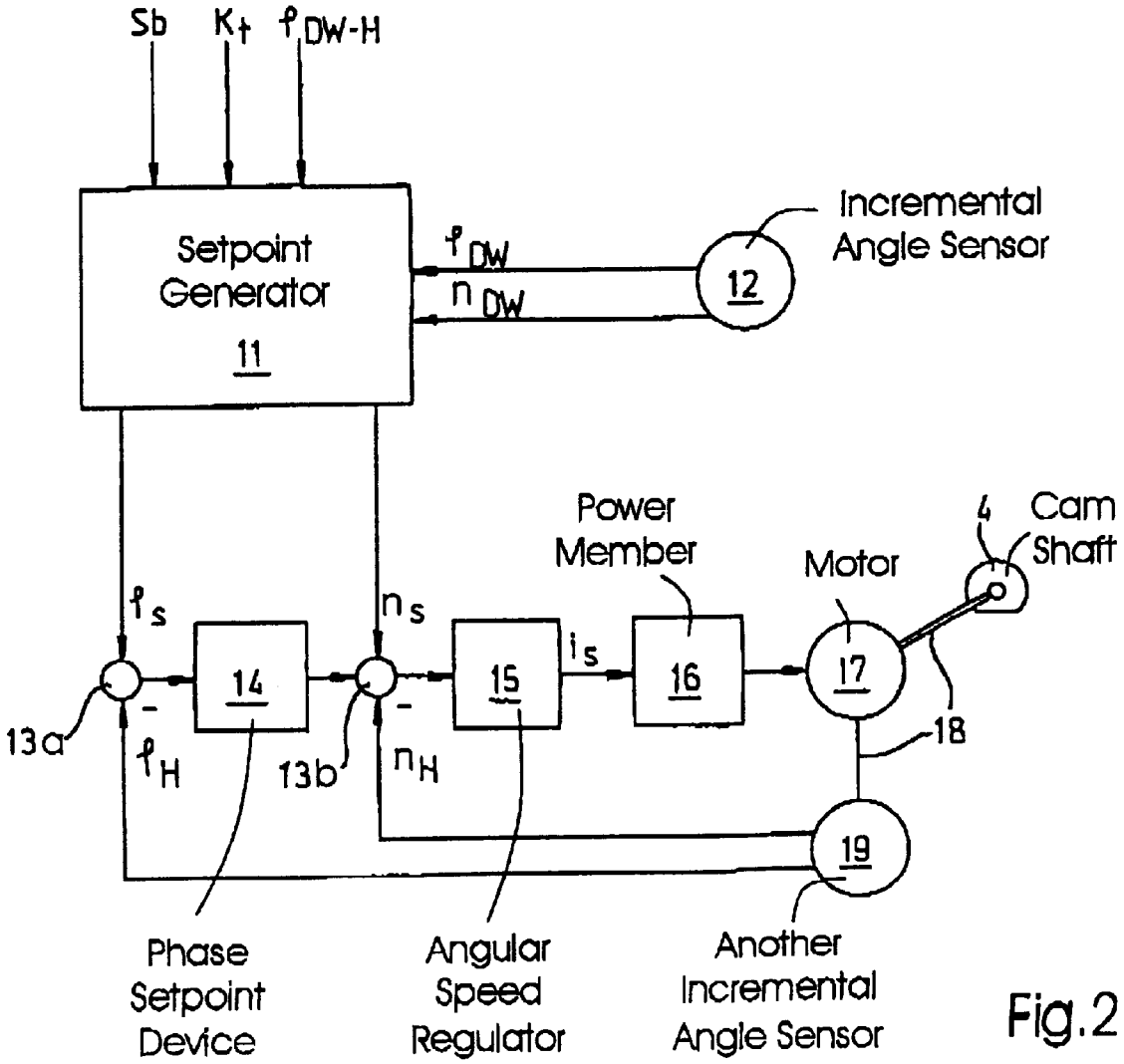
FIG. 2 is a diagrammatic view of a system for regulating the ink strip width, the ink ductor speed and the phase position according to the invention.

FIG. 2 illustrates a setpoint generator 11 that receives the following values input by an operator:

Sb=the strip width, i.e., the amount of ink to be transferred from the fountain roller 6 to the ink ductor roller 1;

Kt=the ink ductor speed, i.e., the number of ductor beats per machine revolution;

$\phi_{DW\text{-}H}$=the phase relationship between the ink ductor and the plate cylinder of the printing unit.

The setpoint generator 11 receives the actual angular speed $\phi_{DW}$ of the plate cylinder of the printing unit and the angular position $\eta_{DW}$ of the plate cylinder of the printing unit from an incremental angular sensor 12. From these input values the setpoint generator 11 produces a setpoint angle $\phi_s$ and an angular speed setpoint $\eta_s$. These setpoint values ($\phi_s$, $\eta_s$) are supplied to an angular phase adjustment device 14 and to an angular speed regulator 15. The angular speed regulator 15 produces a setpoint current $i_s$, which is fed to a power member 16. The power member 16 controls the motor 17, at whose shaft 18 the cam drive 4 is mechanically secured. The motor is preferably a linear drive, such as a linear motor or a piezo actuator. Another incremental angle sensor 19 is disposed on the shaft 18 and determines the actual values of the angular speed $\eta_H$ and the angular position $\phi_H$ of cam shaft 18. These values are fed back to adder stages 13*a* and 13*b* with a negative sign.

Figure 3:
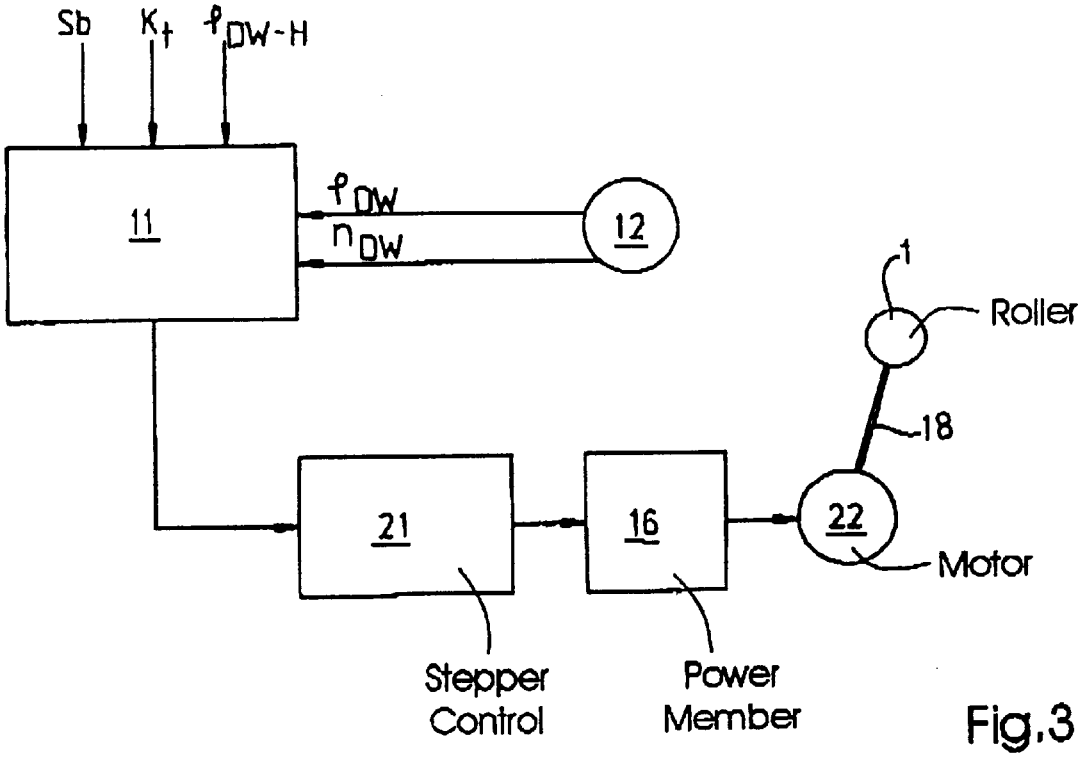
FIG. 3 is a similar view of an embodiment with a stepper motor.

FIG. 3 shows a setpoint generator 11 that, as in FIG. 2, produces a signal from the input signals Sb, Kt, $\phi_{DW\text{-}H}$, $\phi_{DW}$, and $\eta_{DW}$. The signal is fed to a stepper control 21. The stepper control 21 regulates a power member 16, which forms the current supply for the stepping motor 22. The stepper motor 22 moves the ductor roller 1 through a shaft 18 between the fountain roller 6 and the ink distribution roller 7. This embodiment provides the advantage of eliminating feedback with regard to the position of the stepping motor 22.

Figure 4:
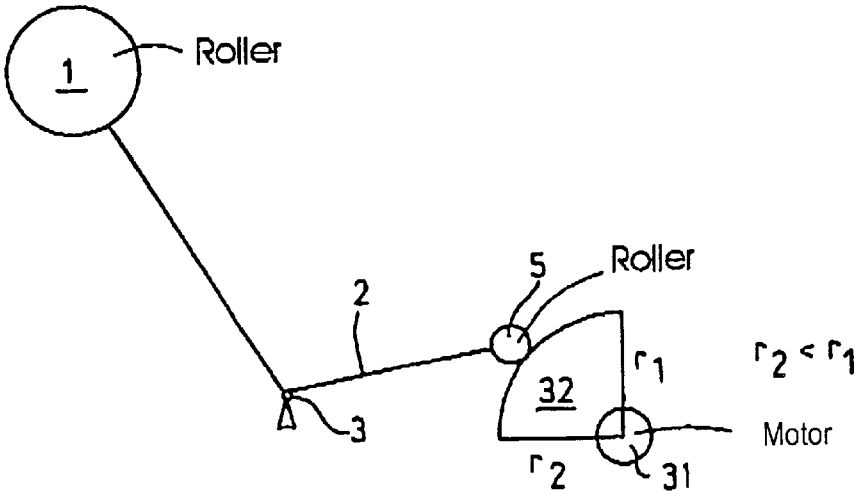
FIGS. 4 and 5 are schematic views of ductor roller swivel systems.

FIG. 4 shows a motor 31—the construction of which is not specified herein—that is connected to a cam disk segment 32. The cam disk segment 32 has different radii $r_1$ and $r_2$. A roller 5 runs on the cam disk segment 32 and the roller 5 is operatively connected with the angled lever 2. The angled lever 2 is articulated about the pivot point 3 and, upon rotation of the motor 31, the angled lever 2 pivots the ductor roller 1 back and forth between the fountain roller 6 and the ink distribution roller 7.

Figure 5:
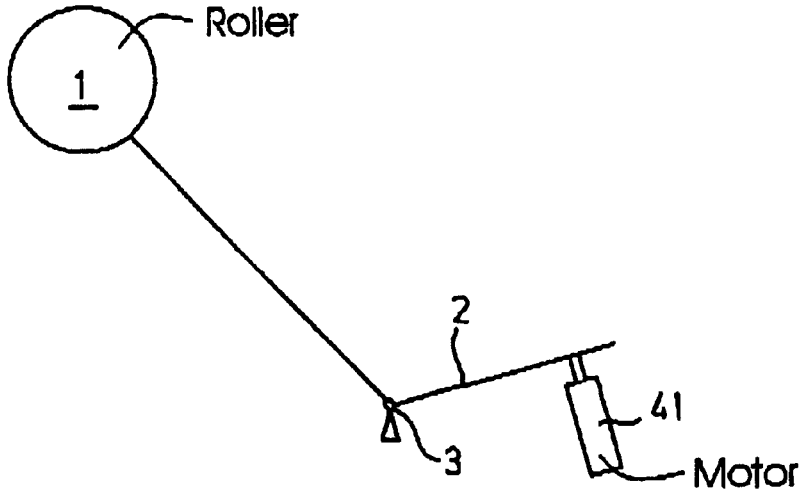

FIG. 5 shows a similar system for swiveling the ductor roller 1 as in FIG. 4, however with a linear motor 41 that directly engages the angled lever 2. The deflection of the linear motor 41 effects a back-and-forth oscillation of the ductor roller 1 through the angled lever 2. The linear motor 41 can also be a piezo actuator 41.

Figure 6:
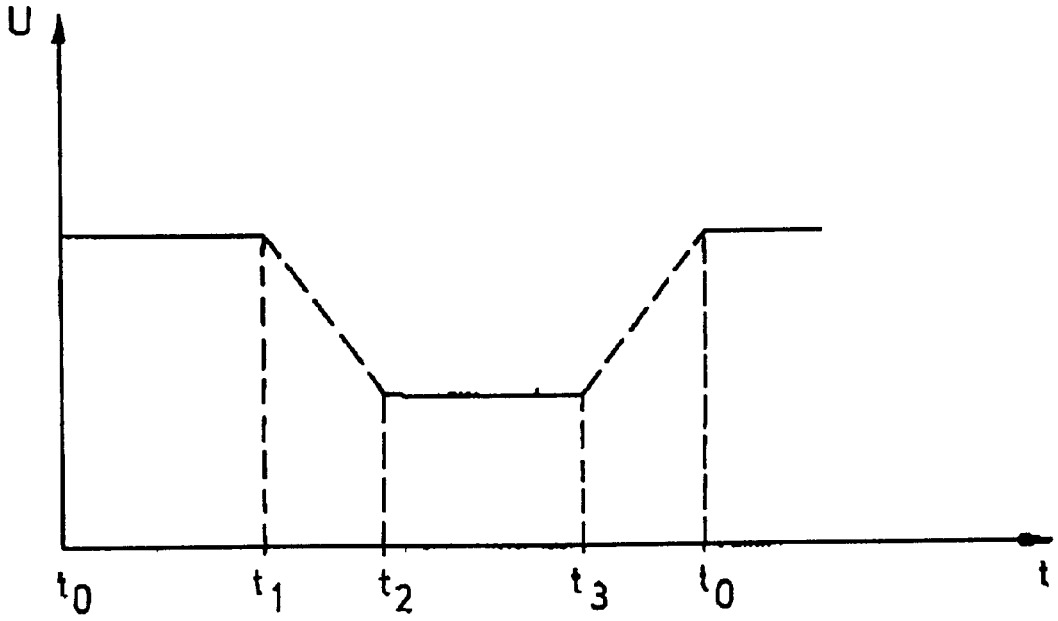
FIG. 6 is a diagrammatic view of the course of the speed U of the ink ductor roller relative to a time line.

FIG. 6 illustrates an idealized course of the peripheral speed U of the ductor roller 1. At time $t_0$, the ductor roller 1 lies in contact with the ink distribution roller 7. Thus, the ink distribution roller 7 drives the ductor roller 1 during the period of time from $t_0$ to $t_1$, i.e., the ink is transferred from the ductor roller 1 to the ink distribution roller 7. At time $t_1$ the ductor roller 1 is separated from the ink distribution roller 7 and swiveled to the fountain roller 6, and the ductor roller 1 contacts the fountain roller 6 at time $t_2$. The speed of the ductor roller 1 is not defined during the period of time between $t_1$ and $t_2$. The peripheral speed of the ductor roller 1 is equal to that of the fountain roller 6 during the period of time from $t_2$ to $t_3$. The ink is thereby transferred from the fountain roller 6 to the ductor roller 1. At time $t_3$, the ductor roller 1 is separated from the fountain roller 6 and is swiveled back to the ink distribution roller 7. In the period of time from $t_3$ to $t_0$, the speed of the ductor roller is again undefined.

The period of time from $t_0$ to $t_1$ and from $t_2$ to $t_3$, as well as the phase position at the times $t_0$ and $t_2$ relative to the movement of the plate cylinder of the printing unit can be individually adjusted by the printing press operator with regard to the specific print job or the properties in the printing unit. A maximum of the time period from $t_2$ to $t_3$ is suitably chosen such that the ductor roller 1 contacts the fountain roller 6 during one revolution.

Figure 2A:
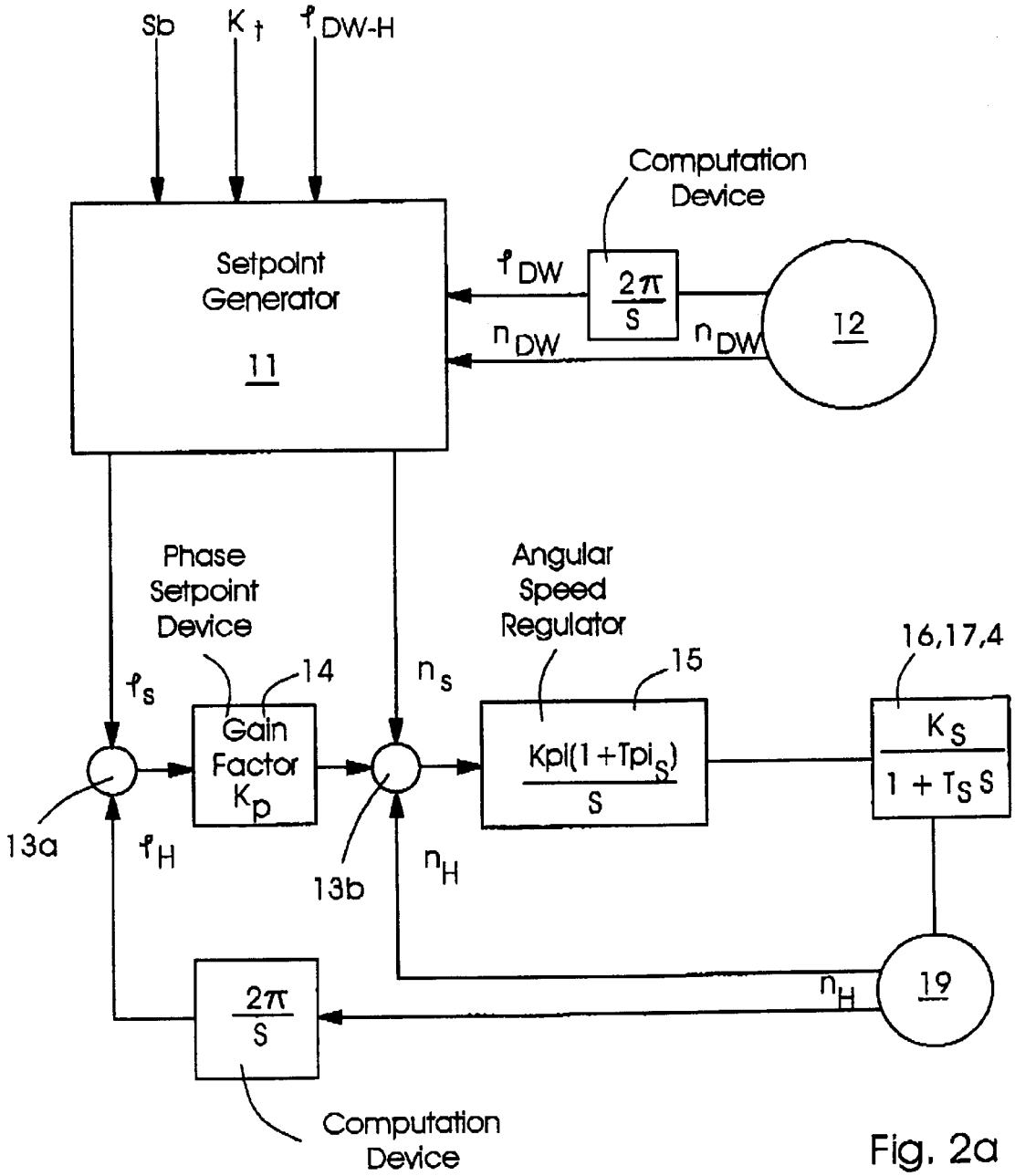
FIG. 2*a* is a more detailed block diagram of FIG. 2 showing additional control functions.

FIG. 2*a* shows more details of the control than FIG. 2, including the setpoint generator 11, the respective angular phase adjustment device 14, and the angular speed generator 15.

Input to the setpoint generator 11 are the values Sb for the ink strip width, the ink ductor speed Kt, i.e., the number of ductor beats per machine revolution, and the phase angle $\phi_{DW\text{-}H}$ between the ductor roller 1 activation and the plate cylinder of the printing unit. This phase angle may, as an example, be entered by the machine operator. The setpoint generator 11 receives additional information relating to the speed of the plate cylinder of the printing unit ($\eta_{DW}$) and its angular position, i.e., phase angle $\phi_{DW}$. These values are provided from the incremental angular sensor 12. In order to provide the angular position, i.e., the phase angle $\phi_{DW}$, an additional computational step is required ($2\pi/S$). The setpoint generator 11 provides from the received inputs (Sb, Kt, $\phi_{DW\text{-}H}$, $\eta_{DW}$, and $\phi_{DW}$), the nominal, i.e., setpoint, values for the phase setpoint device 14 and angular speed regulator 15. The phase setpoint device 14 is constructed as a proportional controller, having a gain factor $K_p$. The angular speed regulator 15 is constructed as a proportional-integral controller having an amplification factor $Kpi(1+Tpi_s)/S$.

The power member 16, the motor 17, and the cam drive 4 in combination provide the control function, which is expressed mathematically by the function $K_s/(1+T_sS)$. The control function performed by the control elements 16, 17, 4 are connected to the incremental angle sensor 19, which provides the rotational speed $\eta_H$ of the motor 17. The rotational speed value $\eta_H$ is coupled through summing circuit 13*b* as an actual value to the angular speed regulator 15, and a computation step $2\pi/S$ provides the angle value $\phi_H$ from the rotational speed value $\eta_H$. The angle value $\phi_H$ is entered into the angular phase adjustment device 14 as an actual angle value $\phi_H$.

After starting the press, the settings are entered, which the printing press operator enters before start of a printing job. These settings are the width Sb of the ink strip applied to the printing material, the ink ductor repetition rate Kt, and the active phase angle of the ductor swivel assembly relative to the plate cylinder. In the next step, the actual printing parameters for the printing unit are entered. The latter are the actual angle position of the printing unit, such as plate cylinder phase angle $\phi_{DW}$ and the actual rotational speed $\eta_{DW}$ of the plate cylinder of the printing unit.

In a next step, a computation is performed, wherein the setpoint values $\phi_{sol1}$ and $\eta_{sol1}$ for the ductor swivel assembly are computed. The setpoint values are next transmitted to the angular phase adjustment device 14 and to the angular speed controller 15. In a last program step, it is determined if the press has stopped. If this is not the case, the process is repeated from the beginning.

The device described herein is particularly suitable for offset and letterpress printing and it is applicable for all undershot fountain inking units.

Figure 2B:
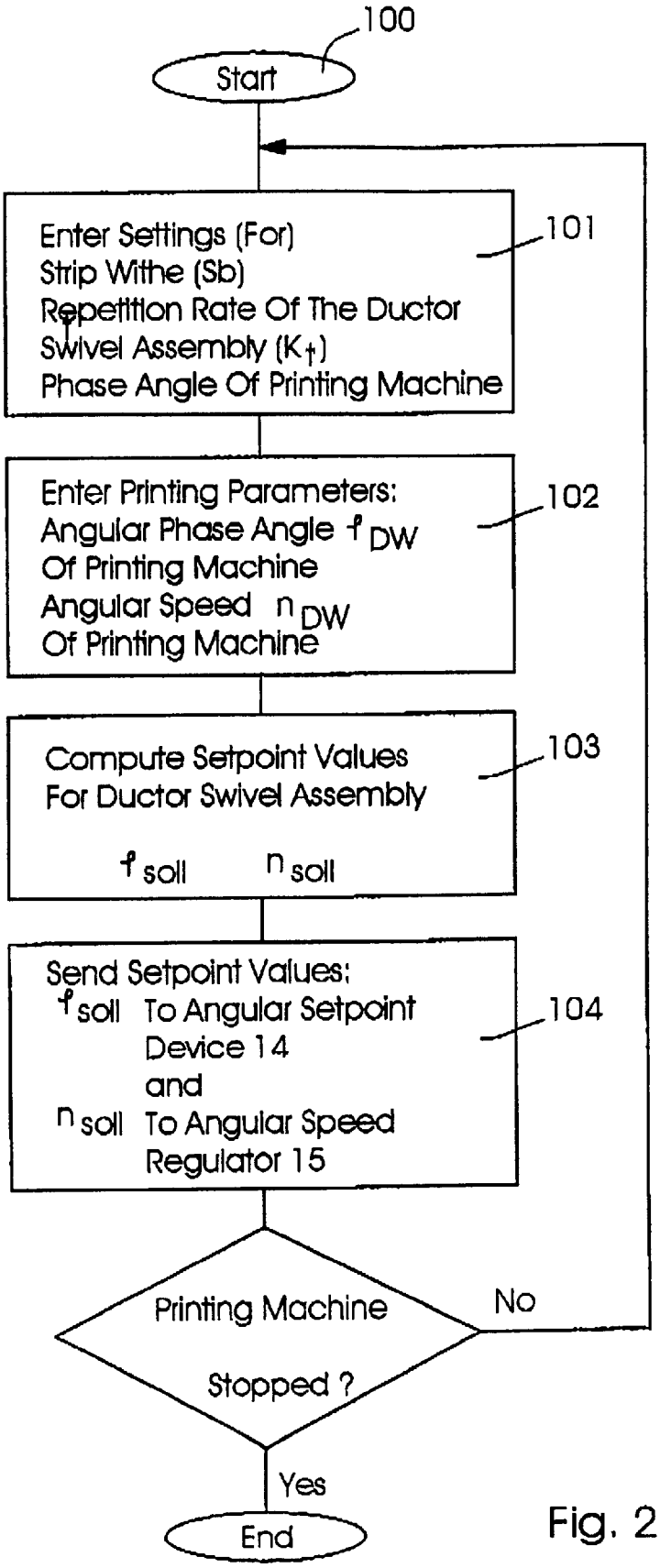
FIG. 2*b* is a flow chart showing the major function steps of the claimed method.

FIG. 2*b* is a flow chart showing the major steps of the disclosed method. After start (100), the printing strip width Sb, the repetition rate Kt, and the phase angle $\phi_{DW\text{-}H}$ of the plate cylinder of printing unit are entered in step 101. In step 102 the printing parameters $\phi_{DW}$, representing the angular position of the plate cylinder of the printing unit, and the rotational speed $\eta_{DW}$ of the plate cylinder of the printing unit are entered. In step 103, the setpoint values, namely the phase setpoint value $\phi S$ and the angular speed $\eta_s$.

We claim:

1. In a printing press having a main drive and a printing unit with an ink fountain, a fountain roller receiving ink from the ink fountain, a first ink roller spaced apart from the fountain roller, a plate cylinder; and an improved assembly for providing exactly metered transfer of printing ink in the printing press comprising:

a ductor roller for receiving an amount of ink from the fountain roller, the amount of ink defining an ink strip width;

a swivel mechanism having a dedicated, discontinuous drive for swiveling said ductor roller back and forth between the fountain roller and the first ink roller, said discontinuous drive independently operable of the main drive of the printing press;

an incremental encoder associated with the plate cylinder of the printing unit for registering a rotational speed and an angular position of the plate cylinder of the printing unit;

a set point generator connected to said discontinuous drive and to said incremental encoder for receiving values of the ink strip width, a speed of said ductor roller, a phase angle between said ductor roller and the plate cylinder of the printing unit, and the rotational speed and angular position of the plate cylinder of the printing unit, said set point generator receiving the rotational speed and the angular position of the plate cylinder of the printing unit from said incremental encoder and using the values of the ink strip width, the speed of said ductor roller, the phase angle between said ductor roller and the plate cylinder of the printing unit, and the rotational speed and angular position of the plate cylinder of the printing unit to calculate set points for said discontinuous drive for swiveling said ductor roller and supplying the set points to said discontinuous drive.

2. The assembly in the printing press according to claim 1, wherein said discontinuous drive is a linear drive.

3. The assembly in the printing press according to claim 2, wherein said linear drive is a linear motor.

4. The assembly in the printing press according to claim 2, wherein said linear drive is a piezo actuator.

5. The assembly in the printing press according to claim 1, including a further incremental encoder connected to said discontinuous drive for determining current values for rotational speed and angular position of said discontinuous drive.

6. The assembly in the printing press according to claim 1, wherein the speed at which said ductor roller is swiveled onto said fountain roller and onto said first ink roller can be regulated.

7. A method for the accurate metered transfer of printing ink from a fountain roller to a first ink roller in an offset printing press having an incremental encoder and a printing unit having a plate cylinder, wherein a ductor roller is swiveled back and forth between the fountain roller and the first ink roller by a swivel mechanism, the swivel mechanism having a dedicated, discontinuous drive and being driven independently of a main drive of the printing press, which comprises:

registering a rotational speed and an angular position of a plate cylinder of a printing unit with an incremental encoder of a printing press;

setting a number of ink feed cycles per plate cylinder revolution by inputting a number of ductor beats per plate cylinder revolution and a dwell time of a ductor roller on a fountain roller; and setting a phase angle at which the ductor roller touches a first ink roller by inputting a phase angle between the ductor roller and the plate cylinder of the printing unit.

8. The method according to claim 7, which comprises adjusting the number of ductor beats per plate cylinder revolution and the dwell time of the ductor roller at the fountain roller and at the first ink roller differently during a printing operation as compared to a non-printing operation.

9. The method according to claim 7, which comprises omitting one or more ductor beats after one or several ductor beats.

10. The method according to claim 7, which comprises driving the swivel mechanism such that, upon printing shut-down, the ductor roller is in contact with the ink distributor roller.

11. The method according to claim 7, which comprises setting the number of ductor beats per plate cylinder revolution separately for each printing unit of the printing press.

* * * * *

UNITED STATES PATENT AND TRADEMARK OFFICE

CERTIFICATE OF CORRECTION

PATENT NO. : 6,112,660
DATED : September 5, 2000
INVENTOR(S) : Rudi Junghans et al.

It is certified that error appears in the above-identified patent and that said Letters Patent is hereby corrected as shown below:

Title page,
Item [22], should read as follows: -- Filed: Aug. 13, 1998 --

Signed and Sealed this

Second Day of July, 2002

*Attest:*

*Attesting Officer*

JAMES E. ROGAN
*Director of the United States Patent and Trademark Office*